United States Patent [19]

Morris et al.

[11] 4,148,671

[45] Apr. 10, 1979

[54] HIGH DUCTILITY, HIGH STRENGTH ALUMINUM CONDUCTOR

[75] Inventors: James G. Morris, Lexington, Ky.; Franklin D. Lemkey, Glastonbury, Conn.

[73] Assignee: United Technologies Corporation, Hartford, Conn.

[21] Appl. No.: 858,315

[22] Filed: Dec. 7, 1977

Related U.S. Application Data

[63] Continuation-in-part of Ser. No. 768,798, Feb. 15, 1977, abandoned.

[51] Int. Cl.[2] ..... C22F 1/04

[52] U.S. Cl. ..... 148/11.5 A; 148/12.7 A; 148/32; 148/32.5

[58] Field of Search ..... 148/11.5 A, 12.7 A, 148/32, 32.5

[56] References Cited

U.S. PATENT DOCUMENTS

| | | | |
|---|---|---|---|
| 3,807,016 | 4/1974 | Schoerner et al. | 148/11.5 A |
| 3,807,969 | 4/1974 | Schoerner et al. | 148/11.5 A |
| 3,830,635 | 8/1974 | Chia et al. | 148/11.5 A |
| 3,989,548 | 11/1976 | Morris | 148/11.5 A |

*Primary Examiner*—W. Stallard

*Attorney, Agent, or Firm*—Charles E. Sohl

[57] ABSTRACT

A high ductility, high strength, moderate conductivity aluminum conductor article and process for making the article are described. The article is a conductor of elongated geometry containing a low volume fraction of intermetallic fibers which are aligned parallel with the major axis of the conductor. The surrounding matrix is aluminum of at least commercial purity to which from 0.5 to 1.5% copper has been added. The fabrication process involves the coupled solidification of eutectic and slightly proeutectic compositions to produce a fibrous microstructure, followed by mechanical working. The ductility of the finished article will exceed about 5%. The final properties may be varied by heat treatments. The broad composition is 1.0–2.0% Co, 0.5–1.5% Cu, balance aluminum.

16 Claims, 1 Drawing Figure

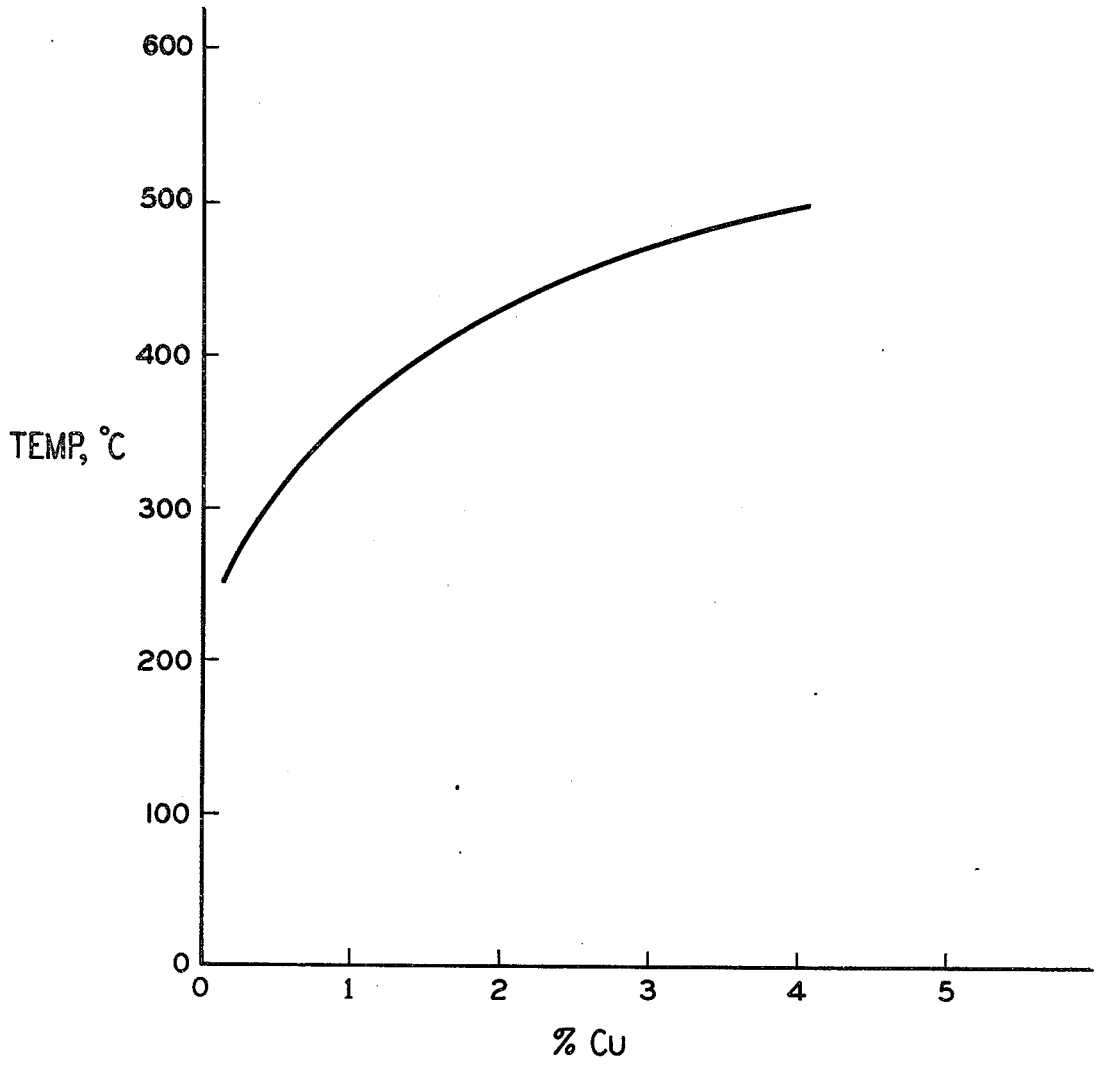
600
500
400
TEMP, °C
300
200
100
0
0
1
2
3
4
5
% Cu

HIGH DUCTILITY, HIGH STRENGTH ALUMINUM CONDUCTOR

CROSS REFERENCE TO RELATED APPLICATION

This application is a continuation-in-part application of U.S. Ser. No. 768,698, filed Feb. 15, 1977, now abandoned.

BACKGROUND OF THE INVENTION

1. Field of the Invention

This invention relates to the field of aluminum alloy conductors. This invention also relates to the field of directional solidification and coupled eutectic growth.

2. Description of the Prior Art

The aluminum conductor art is a crowded one as a result of the great interest shown in this area over a long period of time. Typical of the prior art in this area are U.S. Pat. Nos. 3,807,969 and 3,830,635. These patents disclose aluminum alloys which contain small percentages of nickel and cobalt. Another piece of prior art in U.S. Pat. No. 3,872,917 which discloses an aluminum-iron alloy which is cast and processed to produce a microstructure which contains intermetallic particles of $Al_3Fe$. Other related patents include U.S. Pat. Nos. 3,697,260; 3,725,309; 2,214,432; 3,576,832 and 3,676,111.

Another related piece of prior art is U.S. Pat. No. 3,989,548. This patent discloses the process which involves the directional solidification of aluminum alloys, which contain transition metals, to produce the fibrous microstructure containing from 5–20% by volume of the intermetallic component. This solidified article is then mechanically worked to produce sheet and the long axis of the fiber segments lie in the plane of the sheet. No suggestion of electrical conductor applications is made.

The prior art of U.S. Pat. No. 3,920,411 discloses an aluminum alloy and continuous wheel type casting and rolling process whereby moderate strength ($12–24\times10^3$ psi) and conductivity (50–63%) conductor wire is produced. Ductility values of 12–30% are achieved only after an annealing operation which reduces the drawn wire's tensile strength.

SUMMARY OF THE INVENTION

Aluminum alloys of specific eutectic compositions with copper additions are solidified under conditions which lead to coupled growth. The resultant microstructure contains from about one to about four volume percent of intermetallic fibers in an aluminum matrix which also contains copper. The aluminum eutectic is selected so that the solid solubility of the other constituents in aluminum is exceedingly small. As a result, the electrical conductivity is not adversely affected. The aluminum-cobalt eutectic is preferred. A copper addition is made to strengthen the aluminum matrix. This addition also surprisingly enhances ductility under certain processing conditions. The solidified alloy is mechanically worded to produce an elongated conductor element. The mechanical working process breaks up the intermetallic fibers and aligns the fiber segments so that they are essentially parallel to the long axis of the conductor. The resultant conductor has moderate conductivity combined with high strength. Heat treatments are performed so as to change the relationship of the mechanical and electrical properties, and particularly to provide enhanced ductility together with high tensile strength.

The foregoing and other objects, features and advantages of the present invention will become more apparent in the light of the following detailed description of preferred embodiments thereof as discussed and illustrated in the accompanying drawing.

BRIEF DESCRIPTION OF THE DRAWING

FIG. 1 shows the aluminum-copper solvus curve.

DESCRIPTION OF PREFERRED EMBODIMENTS

A great deal of work has been done in an effort to substitute aluminum for copper in electrical conductor applications. Aluminum is attractive because of its low cost and low density but the conductivity and strength properties of pure aluminum are inferior to those of conductor grade copper alloys. The prior art has endeavored to improve the ratio of strength to conductivity by increasing strength while maintaining conductivity as close as possible to that of pure aluminum.

This invention involves a eutectic between aluminum and another element or compound. The eutectic is selected so that the volume fraction of the second phase which forms in the aluminum matrix is relatively small so that the reduction of the conductivity by this less-conductive second phase is minimal. At least 1% by volume of fibers is necessary for reasonable strengthening but more than about 4% by volume of fibers adversely affects conductivity. The second constraint which is placed upon the eutectic is that the solid solubility of the (nonaluminum) eutectic constituents in the aluminum matrix is minimal. A maximum equilibrium solid solubility near the eutectic temperature of 0.05% can be tolerated but lower solubilities are desired. This restriction is also necessary to ensure maximum conductivity.

The third constraint placed upon the eutectic is that it can be solidified by a process which is termed coupled growth to produce a structure consisting of an aluminum matrix containing second phase fibers. The term coupled growth means that both of the eutectic phases formed simultaneously at the solidification interface and therefore both phases are continuous in the direction of motion of the solidification interface. Another feature of coupled growth is that no primary dendritic phases form. A final constraint is that coupled growth of the eutectic must be possible even when as much as 1.5% of copper is added to the composition and the eutectic should be of a composition in which the copper will partition to the matrix phase rather than the fibrous phase. The additional copper renders the composition heat treatable and provides surprising ductilities under certain conditions of heat treatment. There are several known eutectic compositions which fulfill the constraints set forth above. These include aluminum-cobalt, aluminum-beryllium, and a class of alloys based on eutectics between aluminum and beryllium compounds such as $Al\text{-}CbBe_{13}$ and $Al\text{-}MoBe_{12}$. Analogous compounds exist which contain beryllium along with Ta, Ti, V and Zr. The eutectics which involve beryllium compounds are interesting because the solid solubility of the beryllium compound in the aluminum matrix is nil. Thus, if a eutectic composition is solidified by coupled growth, the solidified material will consist of the beryllium compound in an aluminum-copper matrix. As a practical matter, however, conductors which contain beryllium are not likely to find widespread acceptance because of the high toxicity of beryllium. For this reason, the discussion which follows will be directed towards the aluminum-cobalt system; however, it should be appreciated that alternatives do exist which may have utility in certain highly specialized applications.

The preferred eutectic system is based on the aluminum-cobalt eutectic (with an addition of copper) and the equilibrium eutectic composition is about 1% cobalt. Thus, in the aluminum-cobalt system, coupled growth will occur and a fully eutectic structure will result for cobalt levels of about 1% at very slow solidification rates (rates which approach equilibrium condition). As solidification rates increase, it is necessary to increase the cobalt level if fully coupled growth is to be maintained. By way of example, solidification rates of 2 cm/hr require cobalt levels of about 1% while solidification rate of about 500 cm/hr require cobalt levels of about 1.65% to maintain fully coupled growth. At very high solidification rates, as much as 2% Co may be required to obtain a completely eutectic structure. The presence of the primary metallic phase ($Al_9Co_2$) is undesirable for reasons described below. The primary intermetallic phase has low electrical conductivity and high strength but minimal ductility. The brittle nature of the intermetallic phase makes it unlikely that wire could be successfully produced by conventional means from material which contains any significant amount of the primary intermetallic phase. Thus, it is desirable that the starting composition and the particular casting conditions used be correlated to produce a microstructure which is free from the primary cobalt-aluminum phase. The primary aluminum phase has high conductivity and low strength but is ductile. Since the primary aluminum phase is less detrimental, it can be more readily tolerated than the primary intermetallic phase. The amount of the primary aluminum phase should not exceed thirty volume percent. Of course, increasing amounts of the primary aluminum phase lead to a decrease in mechanical properties, except for ductility, but this may be tolerated for many applications. Intentional additions of copper in amounts of from about 0.5 to about 1.5% are made to the basic aluminum-cobalt eutectic. Copper levels of 0.75% to 1.0% are preferred up to about 25% of the cobalt may be replaced with iron.

The essential parameters which define solidification are G, the thermal gradient in the liquid across the solidification interface, and R, the rate of movement of the solidification interface. The ratio G/R determines the essential solidification characteristics. For extremely high values of G/R plane front solidification will occur, that is to say the solidification front will be planar and all of the second phase elements which form normal to the solidification front will be parallel. Solidification under these conditions is termed plane front directional solidification. For lower values of G/R, the solidification front will become roughened and the resultant microstructure will be cellular and the second phases will not be completely parallel to each other. This is termed directional cellular growth and produces a colony type of microstructure. Finally, for very low values of G/R, the microstructure will become dendritic, consisting of large dendrites of the primary phases. In the Al-Co+Cu system, G/R ratios in excess of about 0.5° C. hr $cm^{-2}$ have been observed to lead to plane front coupled growth. Plane front and cellular solidification both involve coupled growth. Fiber diameters are inversely related to R. High R values produce fine fibers. The preferred range of fiber diameters in the present invention is from about 0.01 to about 2 microns.

The alloys of the invention are heat treatable and can be strengthened by a precipitation hardening mechanism. FIG. 1 shows the solvus curve for copper aluminum alloys. At equilibrium, composition-temperature combinations above the curve will be solid solutions while compositions-conditions below the curve will contain copper rich precipitate particles. It is well known in aluminum copper alloys to use this fact to heat treat such alloys by first heating above the solvus then rapidly cooling below the solvus to produce an unstable (super saturated) material and then reheating it at a lower temperature to permit precipitation to occur. The materials of the present invention may be solution heat treated by heating to a point above the curve for a period of time of from about 10 minutes to 10 hours and then cooling rapidly to a temperature below the solvus so as to suppress precipitation. Since the solution treatment temperature is above the recrystallization temperature, the solution treatment should be performed before the cold working step. Aging may then be performed at a lower temperature for example from about 10° to about 200° F. below the solvus line for a time of from 10 minutes to 30 hours. The aging temperature is most preferably selected to be below the recrystallization or annealing temperature. The aging step may be performed before or after the cold working step, or as an intermediate operation during the cold working step. The effect of various combinations of heat treating steps will be discussed below with reference to actual experimental results. Thus, the matrix of the present invention material can contain copper either in solid solution, or in precipitate form (plus some residual copper in solid solution). As will be described below, certain heat treatments have been found to provide unexpectedly high ductilities.

After the solidification process (and heat treatment), the material is mechanically worked into wire using conventional techniques. For example, the starting material might be cold worked by drawing or swaging from the starting material to final gauge. In laboratory work involving swaging, it was found possible to reduce the cross sectional area of the eutectic material by as much as 98% without intermediate anneals. This is an indication of the great ductility of the material of the invention. Even after 98% reduction in area, the material still had a significant amount of ductility. Alternately, the material may be initially hot worked and then cold worked to final gauge. Of course, any heat treatment operation should be performed after the last hot working operation. In order to achieve reasonable mechanical properties in the finished wire, it is necessary that the finished wire be in a cold worked condition and that the wire have been cold worked at least 80%.

In the as cast condition the aluminum eutectic material will contain elongated second phase (intermetallic) fibers which have a length to diameter ratio of at least 10. Usually, the length to diameter ratio will be much greater and in the case of material produced by plane front solidification, the length to diameter ratio may easily be in excess of 1000:1. The fiber diameters will range from about 0.01 to about 2 microns. Finer diameters are desirable when maximum mechanical properties are desirable but coarser diameters will be more resistant to thermal degradation. The as cast material will usually have an elongated external geometry and the working processes employed to reduce the as cast material to wire will elongate the as cast material in the direction of its original axis of elongation. The effect of the mechanical working will be to break up the fibers so that their average length to diameter ratio is less than 10:1 and usually less than 5:1 and the working operation will align these fiber fragments in the direction of the axis of elongation of the wire conductor.

Table 1 shows properties of a series of alloys produced in accordance with the present invention with different processing sequences. All of the material described in Table I was directionally solidified (a coupled growth process) at 500 cm/hr. Solution heat treatment was performed at 500° C. for 4 hours. Annealing was performed at 370° C. for 10 hours. Aging was performed at 190° C. for 24 hours. Group A material, which has been solidified by coupled growth and then swaged into wire, shows a high ultimate tensile strength, low elongations and relatively low conductivities. The effect of increase in copper can be seen as an increase in ultimate tensile strength and a decrease in conductivity. Higher copper levels also appear to increase the elongations somewhat.

The group B materials were solidified by coupled growth, solution heat treated so as to place most of the copper in solid solution and then swaged into wire. The effect of the addition of the solution heat treatment can be seen in the elongations and conductivity values. The elongation values, especially those with higher copper levels are seen to be unusually high, particularly when compared with the group A material with little effect on the ultimate tensile strength. The solution heat treatment is seen to slightly increase the conductivity as compared with the group A material.

The material in group C was solidified by coupled growth and then swaged to wire and annealed. Comparison of the group C properties with the group A properties shows that high temperature annealing reduces the ultimate tensile strength while increasing the elongation significantly.

TABLE I

| Composition* | Processing | UTS (ksi) | % Elongation | % IACS |
|---|---|---|---|---|
| 1.65 Co, .25 Cu | Coupled growth solidification, | 40.7 | 1–2% | 55.9 |
| 1.65 Co, .50 Cu | 98% RA by swaging. (Group A) | 50.6 | 2–3% | 53.4 |
| 1.65 Co, .75 Cu | | 54.8 | 1–3% | N.M. |
| 1.65 Co, 1.0 Cu | | 63.0 | 1–4% | N.M. |
| 1.65 Co, .25 Cu | Coupled growth solidification | 40.6 | 2–3% | 56.7 |
| 1.65 Co, .50 Cu | Solution heat treated, 98% RA | 50.7 | 3–9% | 54.8 |
| 1.65 Co, .75 Cu | by swaging. (Group B) | 50.4 | 9–21% | 53.5 |
| 1.65 Co, 1.0 Cu | | 61.8 | 16–25% | 52.2 |
| 1.65 Co, .25 Cu | Coupled growth solidification, | 21.7 | 18–21% | N.M. |
| 1.65 Co, .50 Cu | 98% RA by swaging, annealed. | 24.3 | 19–22% | N.M. |
| 1.65 Co, .75 Cu | (Group C) | 24.6 | 14–18% | N.M. |
| 1.65 Co, 1.0 Cu | | 25.0 | 13–18% | N.M. |
| 1.65 Co, .25 Cu | Coupled growth solidification, | 21.8 | 19–23% | 57.9 |
| 1.65 Co, .50 Cu | solution heat treated, 98% RA | 22.5 | 20–28% | 57.9 |
| 1.65 Co, .75 Cu | by swaging, annealed. | 23.3 | 22–30% | 56.3 |
| 1.65 Co, 1.0 Cu | (Group D) | 23.5 | 28–30% | 54.8 |
| 1.65 Co, .25 Cu | Coupled growth solidification, | 42.5 | 2–4% | N.M. |
| 1.65 Co, .50 Cu | solution heat treated, aged, | 51.0 | 2–4% | N.M. |
| 1.65 Co, .75 Cu | 98% RA by swaging. (Group E) | 48.0 | 4–6% | N.M. |
| 1.65 Co, 1.0 Cu | | 59.5 | 9–15% | N.M. |
| 1.65 Co, .25 Cu | Coupled growth solidification, | 22.0 | 20–25% | N.M. |
| 1.65 Co, .50 Cu | solution heat treated, aged, | 22.8 | 20–30% | N.M. |
| 1.65 Co, .75 Cu | 98% RA by swaging, annealed. | 24.2 | 25–27% | N.M. |
| 1.65 Co, 1.0 Cu | (Group F) | 25.2 | 22–27% | N.M. |

N.M. = Not Measured

The group D material was solidified by coupled growth, solution heat treated to place the copper in solid solution then swaged to wire and annealed. As might be expected, the effect of the anneal is to effectively eliminate any effect of the prior solution heat treatment and this can be confirmed by comparing the properties of the group D material with the group C material. The group D material is also seen to have unusually high ductilities.

The group E material was solidified by coupled growth solution, solution heat treated, aged at a low temperature to precipitate the copper solute atoms out of solid solution and then swaged into wire. The properties of this group can logically be compared with the properties of group B and it would appear that the aging treatment reduces the elongation without significantly increasing the ultimate tensile strength. In addition, an improvement in the yield strength was noted compared to group B. The electrical conductivity was not measured, but it would be expected to increase only slightly as a result of the precipitation process. The group F materials were solidified by coupled growth, solution heat treated to place the copper in solid solution, swaged into wire and aged to precipitate the copper and then annealed. Again, the high temperature annealing step appears to undo most of the effects of preceding thermal treatments. Comparing the group F results with the groups C and D results one can see that the properties are quite similar.

From this table, two types of treatment can be singled out as producing especially useful properties. The first is the treatment sequence applied to the group B materials, namely, solidification by coupled growth followed by solution heat treatment above the copper solvus temperature for a time sufficient to place most of the copper in solid solution followed by a mechanical working into wire. This processing sequence yields high ultimate tensile strength values combined with high elongation values and usable conductivity values. The other useful processing sequence would appear to be that which was employed on the group E samples which was basically that employed with the group B samples with the addition of an aging step after the material is drawn into wire. The results on this processing sequence are properties which are similar to that produced by the group B processing sequence and characterized by higher yield (proportional limit) stresses.

The common factor in these two preferred heat treatment sequences is that the deformation is applied to material in the solution treated conditions. Heat treatments of this nature are necessary to produce the unusually high ductility values observed.

By way of comparison, two high strength aluminum conductor materials used in the prior art are alloy 5005 in the H19 condition and alloy 6201 in the T81 condition. The minimum tensile strength for 5005-H19 is 36 KSI, the minimum elongation is 1.5% and the minimum conductivity is 53.5%. For alloy 6201-T81, the minimum tensile strength is 46 KSI, the minimum elongation is 3% and the minimum conductivity is 52.5%. These properties are those specified by the Aluminum Association. By reference to Table I, it can be seen that the alloys of the present invention are capable of surpassing the requirements set for both these prior art commercial alloys.

As used throughout this application, all percentages are weight percentages unless otherwise specified.

Although this invention has been shown and described with respect to a preferred embodiment thereof, it should be understood by those skilled in the art that various changes and omissions in the form and detail thereof may be made therein without departing from the spirit and scope of the invention.

Having thus described a typical embodiment of our invention, that which we claim as new and desire to secure by Letters Patent of the United States is:

1. A high strength high conductivity aluminum conductor of elongated geometry comprising:

an aluminum matrix containing from about 0.5 to about 1.5% Cu surrounding a plurality of $Al_9Co_2$ intermetallic fibers oriented parallel to the axis of elongation of the conductor, with the fibers having a diameter of from about 0.1 to about 2 microns, said fibers comprising from about 1 to about 4% by volume of the conductor, said conductor being characterized by ductilities in excess of about 5%.

2. A conductor as in claim 1 wherein the matrix contains from 0.75 to 1.0% Cu.

3. A conductor as in claim 1 wherein the conductor has been cold worked at least 80%.

4. A conductor as in claim 1 wherein the copper is in solid solution in the matrix.

5. A conductor as in claim 1 wherein at least some of the copper in the matrix is in the form of copper rich precipitates.

6. A method for producing a high strength high conductivity aluminum conductor including the steps of:

(a) providing an aluminum-cobalt-copper material substantially of eutectic composition which when solidified will produce an aluminum matrix containing from about 1 to about 4 volume percent of the $Al_9Co_2$ intermetallic, with the matrix further containing from about 0.01 to about 2.0% Cu;

(b) solidifying the eutectic under conditions of coupled growth to produce $Al_9Co_2$ intermetallic fibers in an aluminum-copper matrix;

(c) heat treating the solidified eutectic at a temperature above the solvus temperature so as to place the copper in solid solution;

(d) working the solidified eutectic at least 80% to break up the $Al_9Co_2$ intermetallic fibers and orient the broken up fibers.

7. A method as in claim 6 in which the solution treated eutectic is aged at a temperature below the solvus temperature to precipitate at least a portion of the copper as a copper rich precipitate, said aging step being performed prior to step d.

8. A method as in claim 7 wherein the aging step is performed at an intermediate point during step d.

9. A method as in claim 7 wherein the aging step is performed subsequent to step d.

10. A method as in claim 6 in which the working operation includes a hot working operation followed by a cold working operation.

11. A method as in claim 10 in which the solidified eutectic material is solution heat treated at a temperature above the solvus temperature for a period of time sufficient to place the copper in solid solution and then quenched to a temperature below the solvus temperature, said solution heat treatment being performed as step c.

12. A method as in claim 11 in which the solution treated eutectic is aged at a temperature below the solvus temperature to precipitate the copper as copper rich precipitate, said aging step being performed immediately prior to the cold working portion of step d.

13. A method as in claim 12 wherein the aging step is performed at an intermediate point during the cold working portion of step d.

14. A method as in claim 12 wherein the aging step is performed subsequent to the cold working portion of step d.

15. A conductor as in claim 1 wherein up to about 25% of the Co in the $Al_9Co_2$ intermetallic is replaced with Fe.

16. A method as in claim 6 wherein up to about 25% of the Co in the $Al_9Co_2$ intermetallic is replaced with Fe.

* * * * *

UNITED STATES PATENT AND TRADEMARK OFFICE

CERTIFICATE OF CORRECTION

PATENT NO. : 4,148,671

DATED : April 10, 1979

INVENTOR(S) : JAMES G. MORRIS ET AL

It is certified that error appears in the above-identified patent and that said Letters Patent are hereby corrected as shown below:

| | |
|---|---|
| Column 1, line 8 | "U.S. Ser. No. 768,698" should read -- U.S. Ser. No. 768,798 -- |
| Column 1, line 22 | "in" should read -- is -- |
| Column 1, line 23 | "U.S. Pat. No. 3,872,917" should read -- U.S. Pat. No. 3,827,917 -- |
| Column 1, line 61 | "worded" should read -- worked -- |

Signed and Sealed this

*Thirty-first* Day of *July 1979*

[SEAL]

*Attest:*

*Attesting Officer*

LUTRELLE F. PARKER

*Acting Commissioner of Patents and Trademarks*